US009674618B2

(12) United States Patent
Uchida et al.

(10) Patent No.: US 9,674,618 B2
(45) Date of Patent: Jun. 6, 2017

(54) ACOUSTIC SENSOR AND MANUFACTURING METHOD OF THE SAME

(71) Applicant: OMRON CORPORATION, Kyoto (JP)

(72) Inventors: Yuki Uchida, Shiga (JP); Koji Momotani, Kyoto (JP); Takashi Kasai, Shiga (JP)

(73) Assignee: OMRON CORPORATION, Kyoto (JP)

( * ) Notice: Subject to any disclaimer, the term of this patent is extended or adjusted under 35 U.S.C. 154(b) by 0 days.

(21) Appl. No.: 14/972,354

(22) Filed: Dec. 17, 2015

(65) Prior Publication Data

US 2016/0192082 A1 Jun. 30, 2016

(30) Foreign Application Priority Data

Dec. 26, 2014 (JP) ..... 2014-265508

(51) Int. Cl.
*H04R 19/00* (2006.01)
*H04R 19/04* (2006.01)
*H04R 31/00* (2006.01)

(52) U.S. Cl.
CPC ..... *H04R 19/005* (2013.01); *H04R 19/04* (2013.01); *H04R 31/00* (2013.01); *H04R 2201/003* (2013.01)

(58) Field of Classification Search
CPC ..... B81B 2203/0127
See application file for complete search history.

(56) References Cited

U.S. PATENT DOCUMENTS 7,570,773 B2 * 8/2009 Ohbayashi ..... H04R 19/016 381/174
8,327,711 B2 * 12/2012 Kasai ..... H04R 19/005 73/649
8,374,364 B2 * 2/2013 Kasai ..... H04R 19/005 257/416
8,952,468 B2 2/2015 Ishimoto et al.

FOREIGN PATENT DOCUMENTS

JP 2011-250170 12/2011

* cited by examiner

*Primary Examiner* — Cuong Q Nguyen
*Assistant Examiner* — Nishath Yasmeen
(74) *Attorney, Agent, or Firm* — Greenblum & Bernstein, P.L.C.

(57) ABSTRACT

An acoustic sensor is provided for improving shock resistance performance, along with a method for manufacturing the acoustic sensor. In the acoustic sensor, a fixing plate is provided by a semiconductor manufacturing process, a frame wall has a curved shape in at least a portion of the periphery of the fixing plate, the frame wall being coupled to the semiconductor substrate. A sacrifice layer removed from the inner side of the fixing plate in the manufacturing process remains at least on a portion of the inner side of the frame wall. Roughness of the remaining sacrifice layer is smaller than roughness of a sound shape reflecting structure in which a shape similar to the external shape of sound holes is repeated. Roughness of the sound shape reflecting structure is formed when removing the sacrifice layer using etching liquid supplied from the plurality of sound holes in the semiconductor manufacturing process.

6 Claims, 9 Drawing Sheets

Embodiment

Comparative example

Embodiment

Comparative example

Embodiment

Comparative example

FIG. 12A
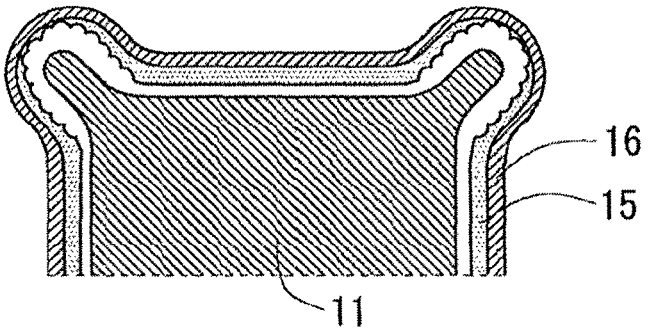
FIG. 12B
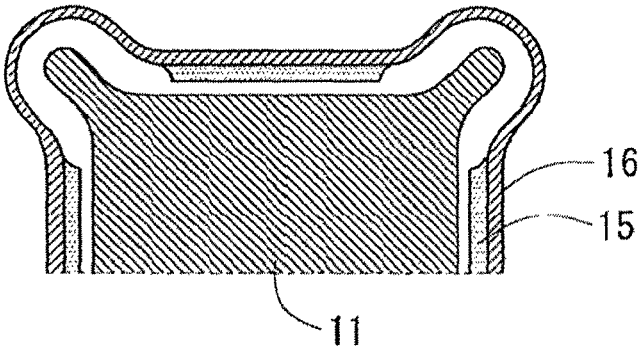
FIG. 13A
FIG. 13B
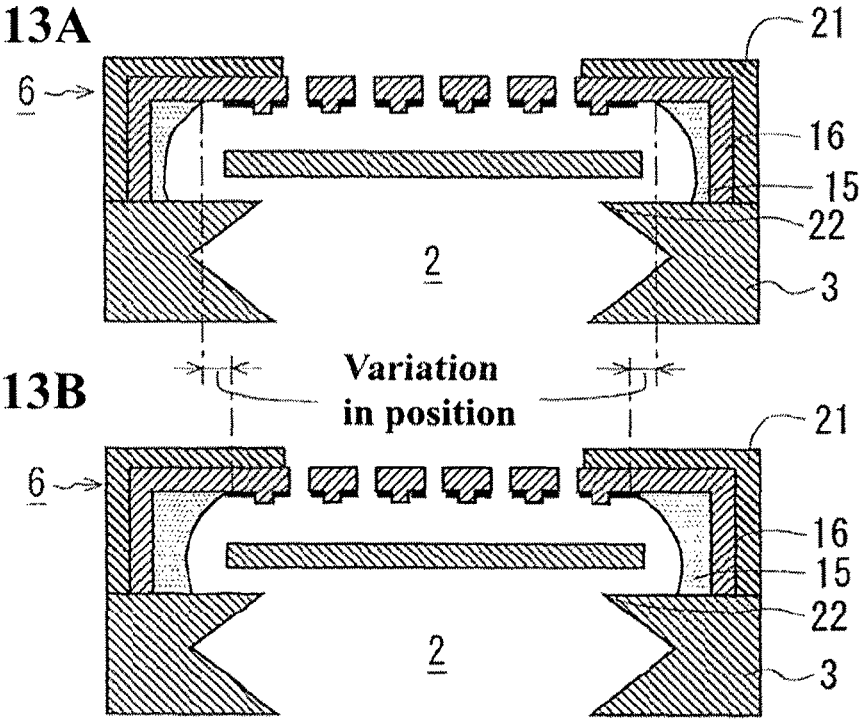

ACOUSTIC SENSOR AND MANUFACTURING METHOD OF THE SAME

CROSS-REFERENCES TO RELATED APPLICATIONS

This application claims priority to Japanese Patent Application No. 2014-26550x8 filed Dec. 26, 2014, the entire contents of which are incorporated herein by reference.

FIELD

The present application discloses an acoustic sensor and a method for manufacturing the acoustic sensor.

BACKGROUND

Conventionally, microphones using an acoustic sensor called an ECM (Electret Condenser Microphone) as a compact microphone have been used. However, because the ECM is easily affected by heat and a microphone using an acoustic sensor manufactured using an MEMS (Micro Electro Mechanical Systems) technique (MEMS microphone) excels in terms of support for digitalization and downsizing, the MEMS microphones have been adopted in recent years (for example, see JP 2011-250170A).

JP 2011-250170A is an example of background art.

SUMMARY

As a type of acoustic sensor, there is an acoustic sensor in which a vibration electrode film that vibrates upon receiving a sound wave is arranged, across a gap, to face a back plate having an electrode film fixed thereto, the acoustic sensor being realized using the MEMS technique. Such an acoustic sensor can be realized by, for example, forming the vibration electrode film on a substrate and forming a sacrifice layer that covers the vibration electrode film, and then forming a back plate on the sacrifice layer and subsequently removing the sacrifice layer. MEMS is a system to which a semiconductor manufacturing technique is applied, and therefore enables a very small acoustic sensor to be obtained. However, commonly, because an acoustic sensor made by using the MEMS technique is constituted by a thinned vibration electrode film and back plate, it is difficult to ensure their shock resistance. In order to address this, for example, it is conceivable to thicken a portion that is structurally likely to be subjected to stress, but it is difficult to thicken a specific site due to restrictions in the film forming process of the semiconductor manufacturing technique. Furthermore, iii the case of thickening the vibration electrode plate and the back plate overall, sensitivity decreases, thermal noise of sound hole portions increases, and noise worsens.

In view of this, a problem to be solved by the present invention involves improving shock resistance performance without being restricted by the semiconductor manufacturing technique and without reducing sensitivity or noise performance.

In order to solve the above problems, in the present invention, in an acoustic sensor provided with a vibration electrode film between a back plate and a semiconductor substrate, a sacrifice layer is allowed to remain on an inner side of a frame wall formed on the periphery of a fixing plate provided on the back plate, and roughness of an inward surface of the sacrifice layer is smaller than roughness of a sound hole shape reflecting structure in which a shape similar to the external shape of sound holes is repeated, the roughness of the sound hole shape reflecting structure being formed in the case of removing the sacrifice layer using etching liquid supplied from the plurality of sound holes.

Specifically, an acoustic sensor that detects acoustic vibration by converting the acoustic vibration into change in electrostatic capacitance between a vibration electrode film and a fixed electrode film, including: a semiconductor substrate having an opening in the surface thereof; a back plate composed of a fixing plate and the fixed electrode film provided on the fixing plate, the fixing plate being arranged to face the opening of the semiconductor substrate and having a plurality of sound holes and the fixed electrode film provided on the fixing plate; and the vibration electrode film arranged between the back plate and the semiconductor substrate so as to face the back plate across a gap, wherein the fixing plate is provided by a semiconductor manufacturing process, and a frame wall is constituted with a curved shape in at least a portion of the periphery of the fixing plate, the frame wall being coupled directly or indirectly to the semiconductor substrate, and a sacrifice layer removed from an inner side of the fixing plate in the semiconductor manufacturing process remains at least on a portion of the inner side of the frame wall, with roughness of the inward surface of the remaining sacrifice layer being smaller than roughness of the sound hole shape reflecting structure in which a shape similar to the external shape of the sound holes is repeated, the roughness of the sound hole shape reflecting structure being formed in the case of removing the sacrifice layer using etching liquid supplied from the plurality of sound holes in the semiconductor manufacturing process.

Here, the sound hole shape reflecting structure is a structure with roughness formed on the sacrifice layer by the streams of the etching liquid flowing in from the plurality of sound holes formed on the fixing plate and radially spreading from the centers of the sound holes so as to etch the sacrifice layer on the inner side of the frame wall, and for example, in the case where the sound holes are circular, a structure in which a plurality of arcuate lines equidistant from the centers of the respective sound holes are placed in rows can be exemplified.

The above acoustic sensor has the sacrifice layer remaining on the inner side of the frame wall formed on the periphery of the fixing plate provided on the back plate. Therefore, in the above acoustic sensor, compared with an acoustic sensor without a remaining sacrifice layer, the frame wall is reinforced by the sacrifice layer, and because the roughness of the inward surface of the sacrifice layer is smaller than the roughness of the sound hole shape reflecting structure, stress concentration due to the roughness is unlikely to occur. Therefore, the above acoustic sensor can improve shock resistance performance compared with a sensor in which a sacrifice layer does not remain.

Note that the plurality of sound holes may be arranged inward of the opening of the semiconductor substrate as viewed from the normal direction of the fixing plate. If the sound holes are arranged in this manner, etching liquid flowing in from the opening of the semiconductor substrate reaches, earlier than etching liquid flowing in from the sound holes, the sacrifice layer that is on the inner side of the frame wall and is outward of the vibration electrode film as viewed from the normal direction of the fixing plate, and thus roughness formed due to the inflow of the etching liquid from the sound holes is mitigated so that the roughness formed on the inward surface of the sacrifice layer remaining on the inner side of the frame wall is smaller than the roughness of the sound hole shape reflecting structure.

Moreover, the semiconductor manufacturing process may include: a step of depositing, on the surface of the semiconductor substrate before the opening is formed, a first sacrifice layer and a second sacrifice layer covering the first sacrifice layer; a step of forming a vibration electrode film on the second sacrifice layer, a step of depositing a third sacrifice layer so as to cover the vibration electrode film; a step of removing the first sacrifice layer; and a step of removing a portion of each of the second and third sacrifice layers, wherein the sound holes may be arranged inward of the external shape of the first sacrifice layer as viewed from the normal direction of the fixing plate. If the sound holes are arranged in this manner, etching liquid flowing in from the opening of the semiconductor substrate reaches, earlier than etching liquid flowing in from the sound holes, the sacrifice layer that is on the inner side of the frame wall and is outward of the vibration electrode film as viewed from the normal direction of the fixing plate, and thus roughness formed due to the inflow of the etching liquid from the sound holes is mitigated so that the roughness formed on the inward surface of the sacrifice layer remaining on the inner side of the frame wall is smaller than the roughness of the sound hole shape reflecting structure.

Furthermore, the sacrifice layer may be composed of at least two layers vertically, and material of the sacrifice layer may be selected such that an etching rate of a lower sacrifice layer is higher than an etching rate of an upper sacrifice layer in the semiconductor manufacturing process. If the lower sacrifice layer has a higher etching rate than the upper sacrifice layer, etching liquid flowing in from the opening of the semiconductor substrate reaches, earlier than etching liquid flowing in from the sound holes, the sacrifice layer that is on the inner side of the frame wall and is outward of the vibration electrode film as viewed from the normal direction of the fixing plate, and roughness formed due to the inflow of the etching liquid from the sound holes is mitigated so that the roughness of the inward surface of the frame wall is smaller than the roughness of the sound hole shape reflecting structure.

Furthermore, an opaque thin film may be further deposited above at least a portion of the fixing plate on which the sacrifice layer remains as viewed from the normal direction of the fixing plate. If the opaque thin film is deposited above at least the portion on which the sacrifice layer remains, the sacrifice layer cannot be viewed through the fixing plate and the frame wall, and therefore it is possible to reduce the possibility that the sensor is erroneously regarded as a defective product because of variation in the position of the sacrifice layer that is a residue produced by etching, further making it possible to achieve structural reinforcement.

Furthermore, the vibration electrode film may have a vibration portion that is substantially quadrilateral as viewed from the normal direction of the fixing plate, and the average thickness of the portions of the sacrifice layer remaining on areas of the frame wall facing the respective sides of the vibration portion may be greater than the average thickness of the portions remaining on other areas of the frame wall. Accordingly, it is possible to cause the sacrifice layer to remain especially on sites that are relatively likely to be damaged, making it possible to effectively improve shock resistance, and furthermore, there is an advantage for downsizing of the acoustic sensor because it is possible to reduce the surface area on which the sacrifice layer is to remain.

Furthermore, the present invention can be appreciated from a method aspect. For example, the present invention may be a method for manufacturing an acoustic sensor including: a step of forming a vibration electrode film facing the surface of a semiconductor substrate, and a sacrifice layer that encompasses the vibration electrode film therein; a step of forming, on the sacrifice layer, a fixing plate that faces the surface of the semiconductor substrate and has a plurality of sound holes, and a frame wall constituted with a curved shape in at least a portion of the periphery of the fixing plate, the frame wall being coupled directly or indirectly to the semiconductor substrate; a step of forming an opening in the semiconductor substrate; and a step of removing the sacrifice layer by etching, wherein in the step of removing the sacrifice layer by etching, etching liquid is supplied from the plurality of sound holes in the fixing plate and the opening in the semiconductor substrate, and the etching liquid supplied from the opening in the semiconductor substrate is caused to reach, earlier than the etching liquid supplied from the sound holes, the sacrifice layer that is on the inner side of the frame wall and is outward of the vibration electrode film as viewed from the normal direction of the fixing plate.

The above acoustic sensor and method for manufacturing the acoustic sensor make it possible to improve shock resistance performance without being restricted by the semiconductor manufacturing technique and without reducing sensitivity or noise performance.

BRIEF DESCRIPTION OF THE DRAWINGS

FIGS. 12A and 12B are second examples of diagrams in which the shape of the inward surface of a sacrifice layer remaining on the inner side of the frame wall is viewed from above.

FIGS. 13A and 13B are diagrams of a third modified example in which an opaque thin film is further provided on an acoustic sensor.

DETAILED DESCRIPTION

Embodiments of the present invention will be described below. Each of the embodiments described below is one aspect of the present invention, and does not limit the technical scope of the present invention.

Figure 1:
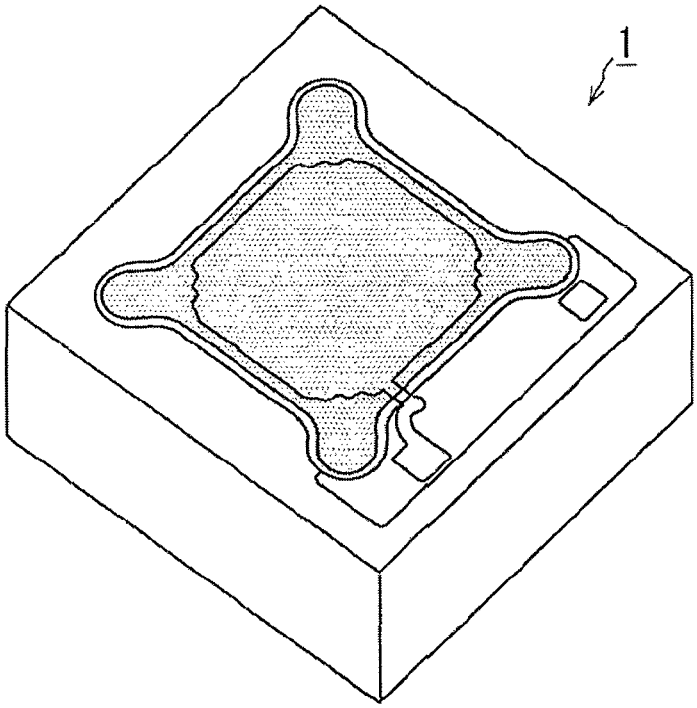
FIG. 1 is a perspective view showing an example of an acoustic sensor according to an embodiment.
Figure 2:
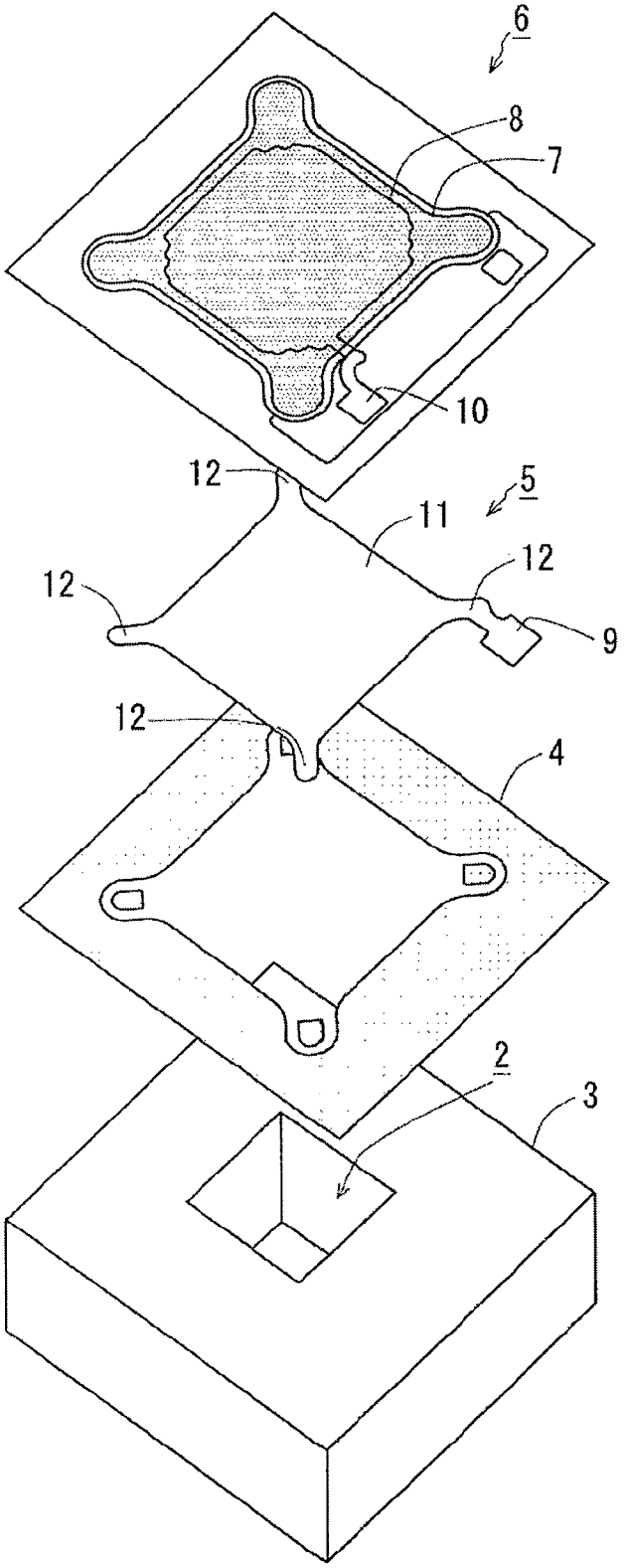
FIG. 2 is an exploded perspective view showing an example of an internal structure of an acoustic sensor.

FIG. 1 is a perspective view showing an example of an acoustic sensor 1 according to an embodiment. Furthermore, FIG. 2 is an exploded perspective view showing an example of the internal structure of the acoustic sensor 1. The acoustic sensor 1 is a layered body in which an insulation film 4, a vibration electrode film (diaphragm) 5, and a back plate 6 are stacked on the top face of a silicon substrate (semiconductor substrate) 3 having a back chamber 2 provided therein. The back plate 6 has a structure in which a fixed electrode film 8 is formed on a fixing plate 7, and the fixed electrode film 8 is arranged on the silicon substrate 3 side of the fixing plate 7.

A plurality of acoustic holes (sound holes) are provided over the entirety of the fixing plate 7 of the back plate 6 (the points of shading over the fixing plate 7 shown in FIG. 1 and FIG. 2 correspond to the individual acoustic holes). Furthermore, a fixed electrode pad 10 is provided at one of the four corners of the fixed electrode film 8.

The silicon substrate 3 can be formed with single crystal silicon having a thickness of approximately 500 μm, for example.

The vibration electrode film 5 can be formed with conductive polycrystal silicon having a thickness of approximately 0.7 μm, for example. The vibration electrode film 5 is a substantially rectangular thin film and has fixing portions 12 provided at the four corners of a substantially quadrilateral vibration portion 11 that vibrates. Moreover, the vibration electrode film 5 is arranged on the top face of the silicon substrate 3 so as to cover the back chamber 2, and is fixed to the silicon substrate 3 at the four fixing portions 12. The vibration portion 11 of the vibration electrode film 5 vibrates vertically in response to sound pressure. A vibration film electrode pad 9 is provided at one of the fixing portions 12 at the four corners. The fixed electrode film 8 provided on the back plate 6 is provided so as to correspond to a portion that vibrates in the vibration electrode film 5 excluding the fixing portions 12 at the four corners. This is because the fixing portions 12 at the four corners in the vibration electrode film 5 do not vibrate in response to sound pressure, and thus the electrostatic capacitance between the vibration electrode film 5 and the fixed electrode film 8 does not change.

When a sound reaches the acoustic sensor 1, the sound passes through the acoustic holes and sound pressure is applied to the vibration electrode film 5. The sound pressure is applied to the vibration electrode film 5 due to these acoustic holes. Furthermore, the acoustic holes are provided so that the air in the air gap between the back plate 6 and the vibration electrode film 5 easily escapes to the outside, and thereby thermal noise is reduced, and noise can be reduced.

In the acoustic sensor 1, due to the above-described structure, the vibration electrode film 5 vibrates in response to a sound, and thereby the distance between the vibration electrode film 5 and the fixed electrode film 8 changes. If the distance between the vibration electrode film 5 and the fixed electrode film 8 changes, the electrostatic capacitance between the vibration electrode film 5 and the fixed electrode film 8 also changes. Therefore, a direct current voltage is applied between the vibration film electrode pad 9 electrically connected to the vibration electrode film 5 and the fixed electrode pad 10 electrically connected to the fixed electrode film 8, and the above change in electrostatic capacitance is extracted as an electrical signal, and therefore sound pressure can be detected as an electrical signal.

The acoustic sensor 1 is manufactured through the following manufacturing process. FIGS. 3A to 3E are explanatory views showing an outline of the manufacturing process of the acoustic sensor 1.

Figure 3A:
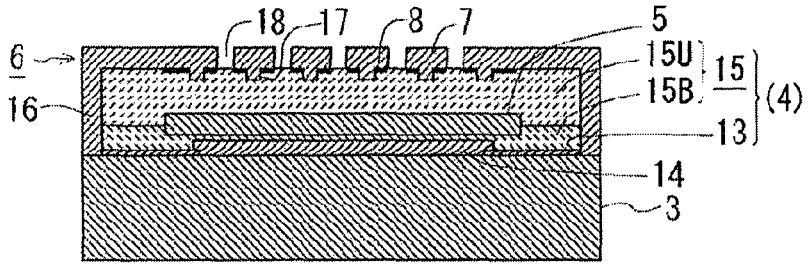
FIGS. 3A to 3E are explanatory views showing an outline of a manufacturing process for an acoustic sensor.

First, a lower sacrifice layer (silicon oxide) 13 is formed on the surface of the silicon substrate 3. A rectangular portion of the lower sacrifice layer 13 corresponding to the central portion of the vibration electrode film 5 is removed so as to define the shape of the opening of the back chamber 2 when etching the silicon substrate 3. A first sacrifice layer (polysilicon) 14 that is larger than the vibration electrode film 5 is then formed over a portion corresponding to the vibration electrode film 5 on the upper side of the lower sacrifice layer 13. Then, a second sacrifice layer (silicon oxide) 15B, a vibration electrode film (polycrystal silicon) 5, a third sacrifice layer (silicon oxide) 15U, a back plate (a metal thin film or an insulation layer such as silicon nitride) 6, a frame wall 16 that supports the fixing plate 7, and protruding stoppers 17 that protrude from the back plate 6 to the vibration electrode film 5 are formed over the lower sacrifice layer 13 and the first sacrifice layer 14. The lower sacrifice layer 13, the second sacrifice layer 15B and the third the sacrifice layer 15U additionally function as an insulation film, and thus portions thereof that remain after etching form the above-described insulation film 4. The stoppers 17 are provided for the purpose of preventing the vibration electrode film 5 that has approached the fixed electrode film 8 from adhering to the fixed electrode film 8. For example, the stoppers 17 can be formed by constituting the third the sacrifice layer 15U to have a two-layer structure and providing depressions corresponding to the stoppers 17 on the upper layer of the two-layer structure. Acoustic holes 18 are then formed in the back plate 6 (FIG. 3A).

Figure 3B:
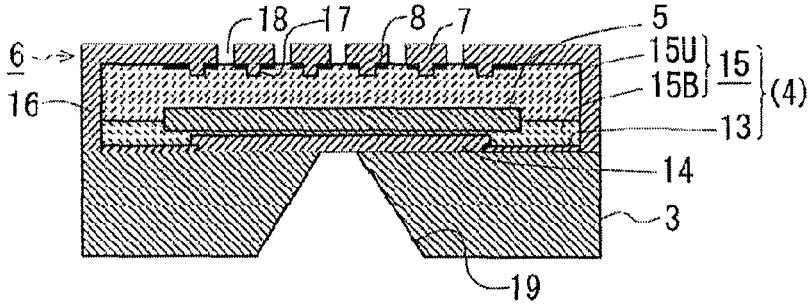
Figure 3C:
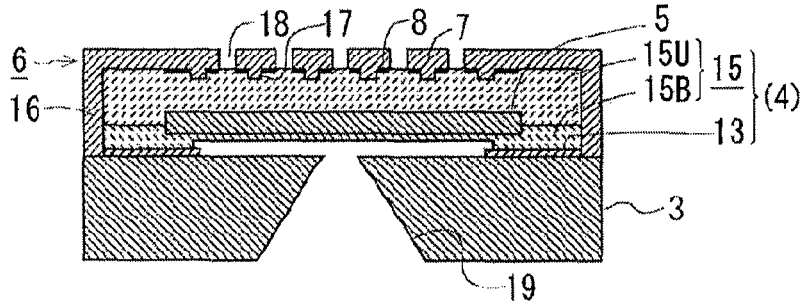
Figure 3D:
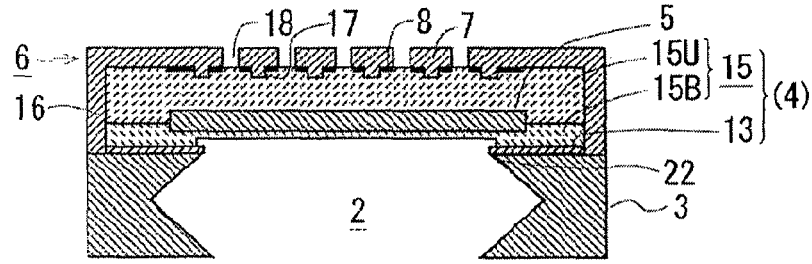
Figure 3E:
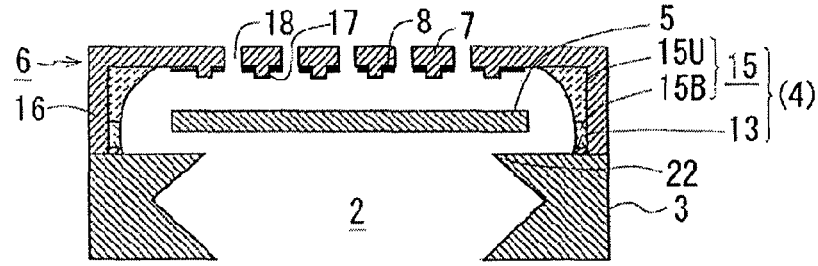

Next, anisotropic etching is performed on the silicon substrate 3 so as to form a penetration hole 19 at a position corresponding to the central portion of the vibration electrode film 5 (FIG. 3B). Anisotropic etching is then performed on the first sacrifice layer 14 through the penetration hole 19 formed on the silicon substrate 3 (FIG. 3C). The silicon substrate 3 is then etched again so as to enlarge the penetration hole 19, and thus the back chamber 2 is completed (FIG. 3D). Subsequently, etching is performed through an opening 22 of the back chamber 2 formed in the silicon substrate 3 and the acoustic holes 18 formed in the fixing plate 7 to an extent to which the second sacrifice layer 15B and the third sacrifice layer 15U remain on the inner side of the frame wall 16 (FIG. 3E). Accordingly, the acoustic sensor 1 is completed. Note that when the second sacrifice layer 15B and the third the sacrifice layer 15U are described collectively below, they are simply referred to as "sacrifice layer 15".

Figure 4A:
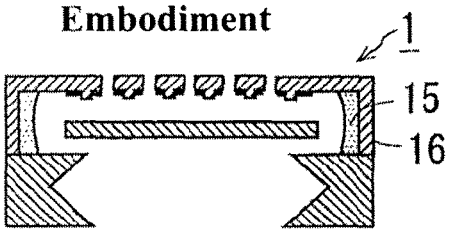
FIGS. 4A and 4B are diagrams for comparing internal structures of an acoustic sensor according to an embodiment and an acoustic sensor according to a comparative example.
Figure 4B:
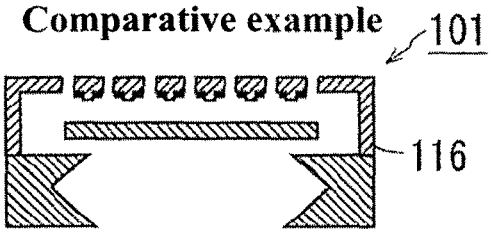

FIGS. 4A and 4B are diagrams for comparing the internal structures of the acoustic sensor 1 according to the embodiment and an acoustic sensor according to a comparative example. In the acoustic sensor 1 according to the embodiment, the sacrifice layer 15 remains on the inner side of the frame wall 16, while in an acoustic sensor 101 according to the comparative example, there is no residue on the inner side of a frame wall 116, and the sacrifice layer has been completely removed by etching. The acoustic sensor 1 according to the embodiment in which the sacrifice layer 15 remains on the inner side of the frame wall 16 has an affect such as the following compared with the acoustic sensor 101 of the comparative example in which the sacrifice layer does not remain on the inner side of the frame wall 116.

Figure 5A:
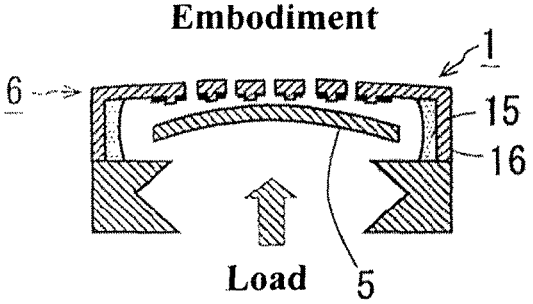
FIGS. 5A and 5B are diagrams for comparing states in the case where a drop test is performed.
Figure 5B:
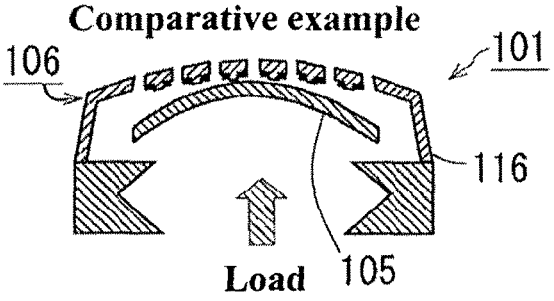

FIGS. 5A and 5B are diagrams for comparing states in the case where a drop test is performed. The frame wall 16 of the acoustic sensor 1 according to the embodiment is reinforced by the sacrifice layer 15 remaining on the inner side of the frame wall 16 and thus has a higher strength than the frame wall 116 of the acoustic sensor 101 of the comparative example. Therefore, in the acoustic sensor 1 according to the embodiment, the vibration electrode film 5 and the back plate 6 are less likely to be damaged in the case where the drop test is performed, compared with the acoustic sensor 101 according to the comparative example.

Figure 6A:
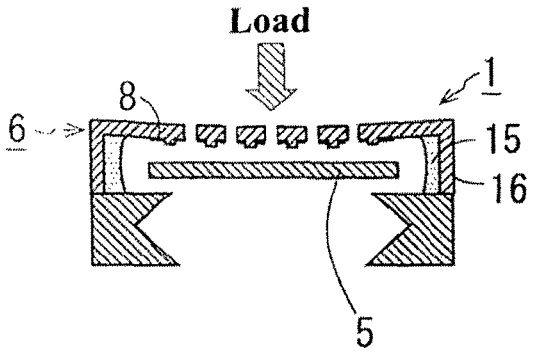
FIGS. 6A and 6B are diagrams for comparing states of flexure caused by a moment.
Figure 6B:
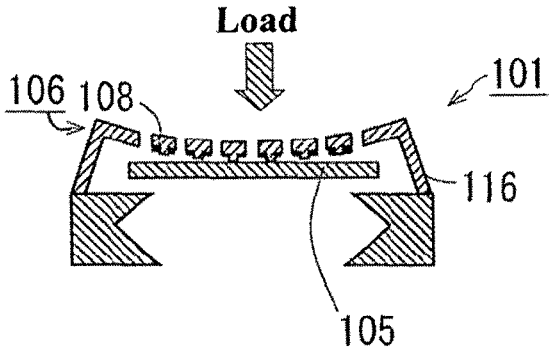

FIGS. 6A and 6B are diagrams for comparing states of flexure caused by a moment. The frame wall 16 of the acoustic sensor 1 according to the embodiment is reinforced by the sacrifice layer 15 remaining on the inner side of the frame wall 16 and thus has a higher strength than the frame wall 116 of the acoustic sensor 101 of the comparative example. Therefore, the back plate 6 of the acoustic sensor 1 according to the embodiment is less likely to be warped than a back plate 106 of the acoustic sensor 101 according to the comparative example, even if a moment due to internal stress of the fixed electrode film 8 or the fixing plate 7 or force produced by a difference in thermal expansion coefficient is applied to the back plate 6. If the back plate 6 or 106 becomes warped, the electrostatic capacitance between the fixed electrode film 8 or 108 and the vibration electrode film 5 or 105 changes, and thus sensitivity can vary. In this regard, in the acoustic sensor 1 according to the embodiment, the back plate 6 is unlikely to be warped, and thus the electrostatic capacitance between the fixed electrode film 8 and the vibration electrode film 5 is unlikely to change and sensitivity is unlikely to vary.

Figure 7:
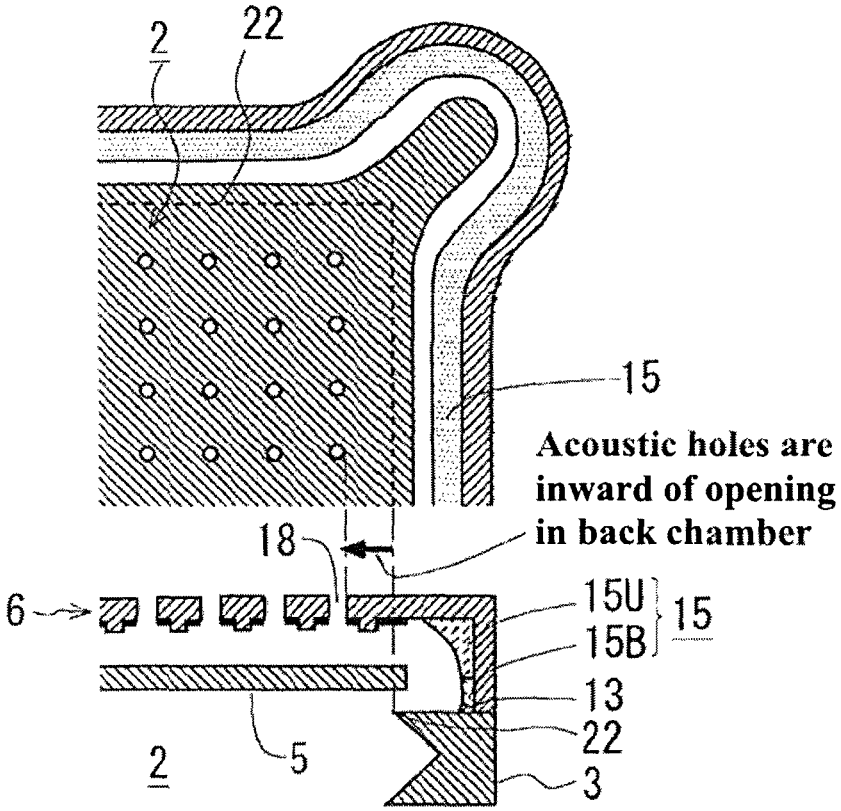
FIG. 7 is an example of a diagram showing the positional relation between acoustic holes and an opening of a back chamber.

Incidentally, in the above description regarding the manufacturing process for the acoustic sensor 1, the positions of the acoustic holes 18 were not especially mentioned, but it is preferable that the acoustic holes 18 are arranged inward of the opening 22 of the back chamber 2 provided in the silicon substrate 3, as viewed from the normal direction of the fixing plate 7 (as viewed from above), for example. FIG. 7 is an example of a diagram showing the positional relation between the acoustic holes 18 and the opening 22 of the back chamber 2. If the acoustic holes 18 are arranged inward of the opening 22 of the back chamber 2 as viewed from above, etching liquid flowing in from the opening 22 of the back chamber 2 reaches, earlier than etching liquid flowing in from the acoustic holes 18, the sacrifice layer 15 that is on the inner side of the frame wall 16 and is outward of the vibration electrode film 8 as viewed from the normal direction of the fixing plate 7, and thus roughness formed due to the inflow of the etching liquid from the acoustic holes 18 is mitigated, and the roughness of the inward surface of the sacrifice layer 15 remaining on the inner side of the frame wall 16 is smaller than the roughness of the sound hole shape reflecting structure.

Figure 8A:
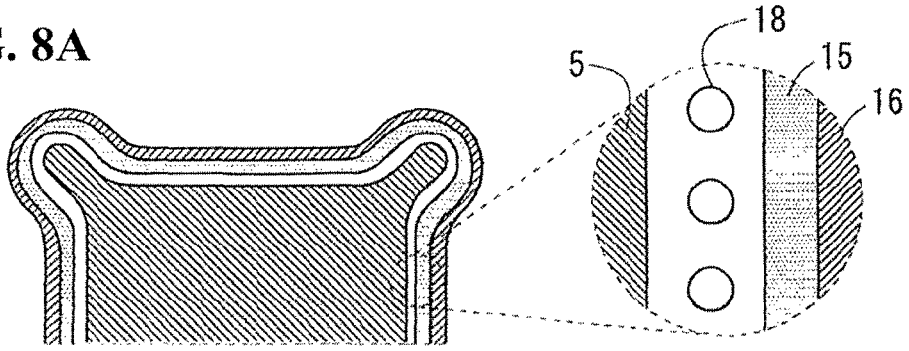
FIGS. 8A and 8B are first examples of diagrams in which the shape of the inward surface of a sacrifice layer remaining on the inner side of a frame wall is viewed from above.
Figure 8B:
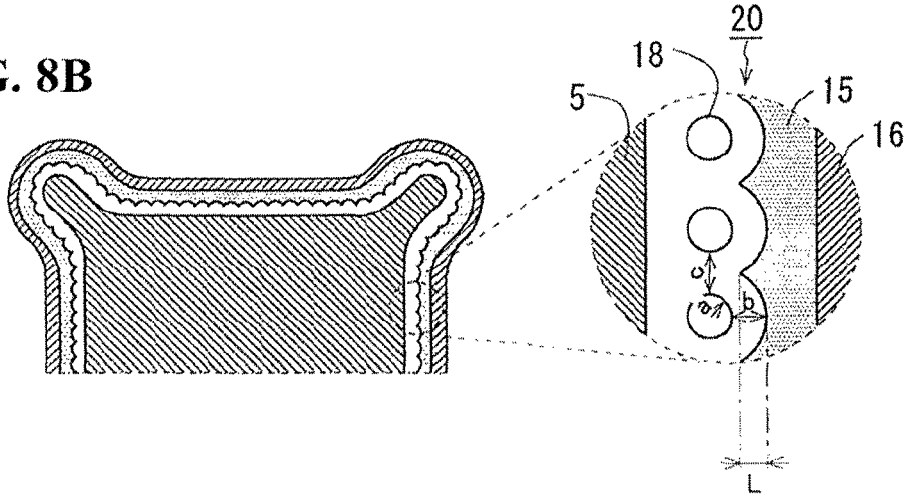

FIGS. 8A and 8B are examples of diagrams in which the shape of the inward surface of the third sacrifice layer is viewed from above. FIG. 8A shows an example of the shape of the inward surface of the sacrifice layer 15 formed in the case where etching liquid flowing in from the opening 22 of the back chamber 2 reaches, earlier than etching liquid flowing in from the acoustic holes 18, the sacrifice layer 15 that is on the inner side of the frame wall 16 and is outward of the vibration electrode film 8 as viewed from the normal direction of the fixing plate 7. On the other hand, FIG. 8B shows an example of the shape of the inward surface of the sacrifice layer 15 formed in the case where etching liquid flowing in from the acoustic holes 18 reaches, earlier than etching liquid flowing in from the opening 22 of the back chamber 2, the sacrifice layer 15 that is on the inner side of the frame wall 16 and is outward of the vibration electrode film 8 as viewed from the normal direction of the fixing plate 7.

In the above manufacturing process, in the etching performed after completing the back chamber 2, the sacrifice layer 15 is etched through the opening 22 of the back chamber 2 formed on the silicon substrate 3 and the acoustic holes 18 formed in the fixing plate 7. Therefore, if the etching liquid flowing in from the acoustic holes 18 reaches, earlier than the etching liquid flowing in from the opening 22 of the back chamber 2, the sacrifice layer 15 that is on the inner side of the frame wall 16 and is outward of the vibration electrode film 8 as viewed from the normal direction of the fixing plate 7, the etching liquid flowing in from the acoustic holes 18 gradually spreads radially from the acoustic holes 18, and will form roughness 20 over the inward surface of the sacrifice layer 15 remaining on the inner side of the frame wall 16 (see the enlarged diagram in FIG. 8B). The roughness 20 has the sound hole shape reflecting structure in which a shape resembling the external shape of the acoustic hole 18 is repeated, and the size thereof can be expressed as described below. For example, if the protruding length of the roughness 20 of the inward surface of the sacrifice layer 15 is denoted by L, the radius of the acoustic hole 18 is denoted by a, the distance from the edge of the acoustic hole 18 to the spread of the etching is denoted by b, and the interval between the acoustic holes 18 is denoted by c, the following relational expression holds true. Note that the protruding length L of the roughness 20 indicates the size of the roughness 20, and thus can be regarded as the size of the sound hole shape reflecting structure.

$$L = a + b - \sqrt{(a+b)^2 - \left(\frac{c}{2} + a\right)^2} \qquad \text{Equation 1}$$

As is evident from the above relational expression, it can be seen that the size of the roughness 20 varies in accordance with the radius of the acoustic hole 18, the spread of the etching, and the interval between the acoustic holes 18. In view of this, it is ensured that in the manufacturing method according to this embodiment, etching liquid flowing in from the opening 22 of the back chamber 2 reaches, earlier than etching liquid flowing in from the acoustic holes 18, the sacrifice layer 15 that is on the inner side of the frame wall 16 and is outward of the vibration electrode film 8 as viewed from the normal direction of the fixing plate 7, so that the roughness formed due to the inflow of the etching liquid from the acoustic holes 18 is at least smaller than the roughness of the sound hole shape reflecting structure, thereby suppressing the occurrence of stress concentration due to roughness.

Figure 9:
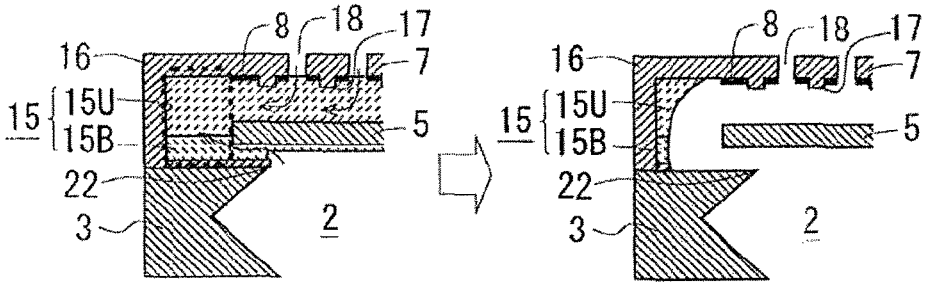
FIG. 9 is a diagram showing an example of the flow of etching liquid in the case where acoustic holes are arranged inward of a back chamber as viewed from the normal direction of a fixing plate.

FIG. 9 is a diagram showing an example of the flow of etching liquid in the case where the acoustic holes 18 are arranged inward of the opening 22 of the back chamber 2 as viewed from the normal direction of the fixing plate 7. If, as with the acoustic sensor 1 of this embodiment, the acoustic holes 18 are arranged inward of the opening 22 of the back chamber 2 provided on the silicon substrate 3 as viewed from the normal direction of the fixing plate 7, the etching liquid supplied from the opening 22 of the back chamber 2 reaches, earlier than the etching liquid flowing in from the acoustic holes 18, a dashed line portion (the sacrifice layer 15 that is on the inner side of the frame wall 16 and is outward of the vibration electrode film 8 as viewed from the normal direction of the fixing plate 7) shown in FIG. 9, and thus it is possible to prevent roughness of the same size as that of the roughness 20, which has the sound hole shape reflecting structure, from being formed on the inner side of the frame wall 16.

Figure 10:
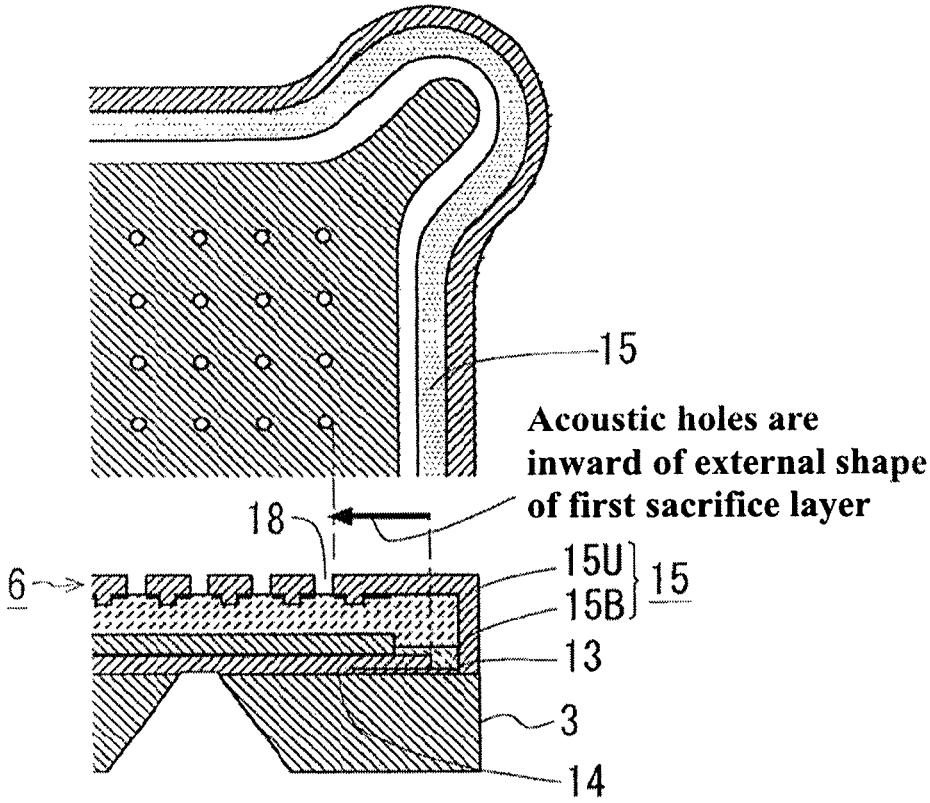
FIG. 10 is an example of a diagram showing the positional relation between acoustic holes and a first sacrifice layer.

Incidentally, in the above description regarding the process for manufacturing the acoustic sensor 1, the positional relation between the position of the acoustic holes 18 and the first sacrifice layer 14 was not especially mentioned, but it is preferable that the acoustic holes 18 are arranged inward of the shape of the first sacrifice layer 14 as viewed from the normal direction of the fixing plate 7, for example. FIG. 10 is an example of a diagram showing the positional relation between the acoustic holes 18 and the first sacrifice layer 14. If the acoustic holes 18 are arranged inward of the shape of the first sacrifice layer 14 as viewed from above, after the first sacrifice layer 14 is removed by being etched, the etching liquid flowing in from the opening 22 of the back chamber 2 can reach, earlier than the etching liquid flowing in from the acoustic holes 18, the sacrifice layer 15 that is on the inner side of the frame wall 16 and is outward of the vibration electrode film 8 as viewed from the normal direction of the fixing plate 7, and thus roughness formed due to the inflow of the etching liquid from the acoustic holes 18 is mitigated, thereby easily making the roughness of the inward surface of the sacrifice layer 15 remaining on the inner side of the frame wall 16 smaller than the roughness of the sound hole shape reflecting structure.

First Modified Example

Incidentally, in the above description regarding the process for manufacturing the acoustic sensor 1, the material of the sacrifice layer 15 was not especially mentioned, but if the material of the sacrifice layer 15 is selected such that the lower second sacrifice layer 15B has a higher etching rate than the upper third sacrifice layer 15U, for example, it is easy to make the roughness of the inward surface of the sacrifice layer 15 remaining on the inner side of the frame wall 16 smaller than the roughness of the sound hole shape reflecting structure. FIGS. 11A to 11E are explanatory views showing an outline of the manufacturing process according to the first modified example.

Figure 11A:
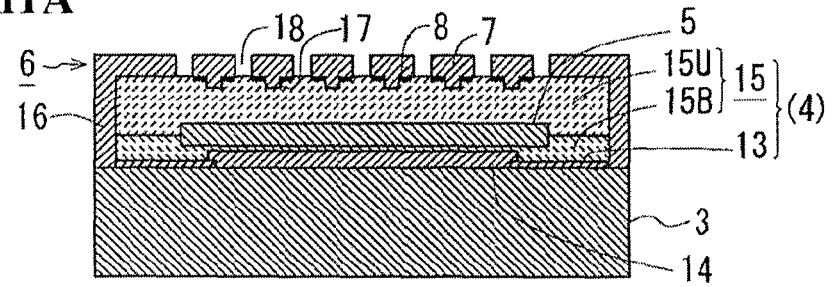
FIGS. 11A to 11E are explanatory views showing an outline of a manufacturing process according to a first modified example.
Figure 11B:
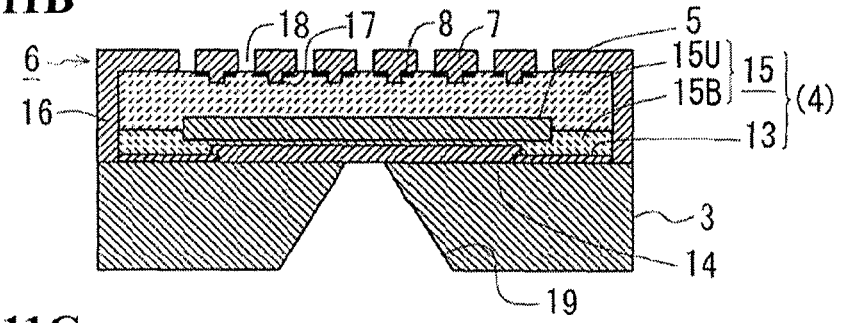
Figure 11C:
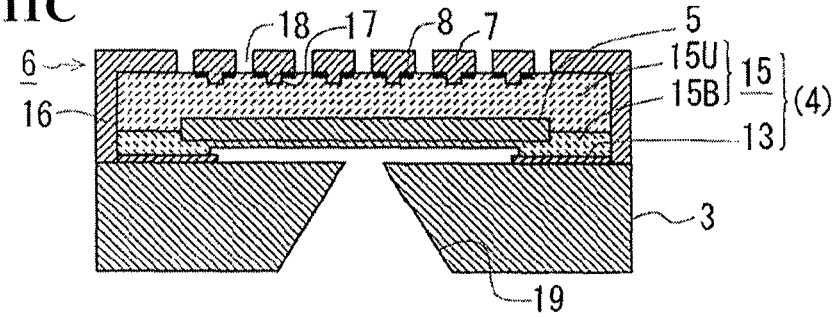
Figure 11D:
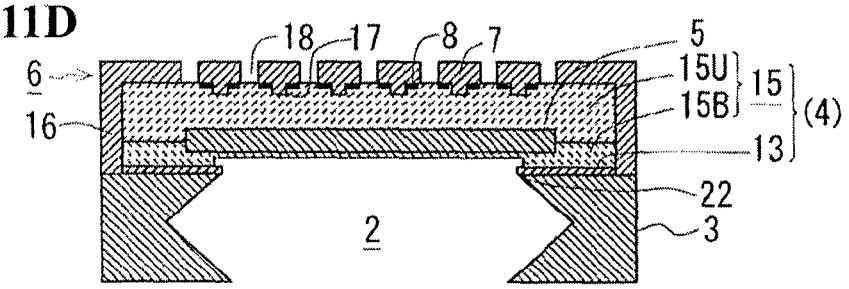
Figure 11E:
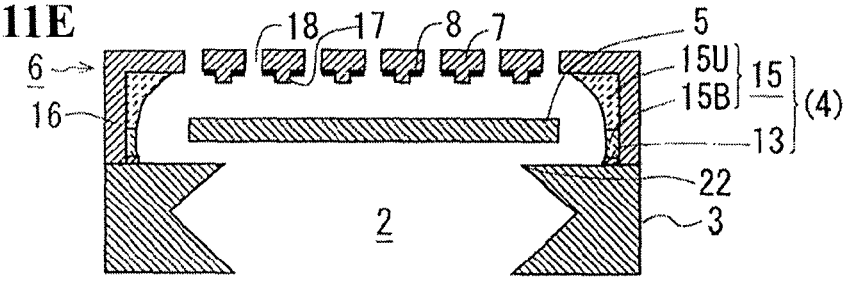

The material of the third sacrifice layer 15U and the material of the second sacrifice layer 15B are selected such that when forming the sacrifice layer 15 on the surface of the silicon substrate 3, the etching rate of the third sacrifice layer 15U is second higher than the etching rate of the layer 15B (FIG. 11A). Next, similarly to the manufacturing process of the above embodiment, the silicon substrate 3 is etched to form the penetration hole 19 (FIG. 11B), the first sacrifice layer 14 is etched through the penetration hole 19 (FIG. 11C), and the silicon substrate 3 is etched again so as to complete the back chamber 2 (FIG. 11D). Subsequently, etching is performed through the opening 22 and the acoustic holes 18 of the back chamber 2 to an extent to which the sacrifice layer 15 remains on the inner side of the frame wall 16 (FIG. 11E). In the case of the manufacturing process according to this modified example, the upper third sacrifice layer 15U of the sacrifice layer 15 has a lower etching rate than the lower second sacrifice layer 15B. Therefore, the etching liquid flowing in from the acoustic holes 18 is unlikely to enter from the acoustic hole 18 deeply into the sacrifice layer 15. Therefore, using the manufacturing process according to this modified example, even if the acoustic holes 18 are not arranged inward of the opening 22 of the back chamber 2 of the silicon substrate 3 as viewed from the normal direction of the fixing plate 7 as shown in FIG. 11, the inflow of the etching liquid from the opening 22 of the back chamber 2 becomes more dominant than the inflow of the etching liquid from the acoustic holes 18, and therefore the roughness of the inward surface of the sacrifice layer 15 remaining on the inner side of the frame wall 16 is smaller than the roughness of the sound hole shape reflecting structure.

Second Modified Example

Note that FIGS. 8A and 8B show the acoustic sensor 1 of the embodiment in which the sacrifice layer 15 remaining on the inner side of the frame wall 16 has a uniform thickness between the portions remaining in areas facing the sides of the vibration portion 11 and the portions remaining in the other areas, but the acoustic sensor 1 according to the above embodiment is not limited to such an aspect. FIGS. 12A and 12B are second examples of diagrams in which the shape of the inward surface of the sacrifice layer 15 remaining on the inner side of the frame wall 16 is viewed from above. In the acoustic sensor 1 according to the above embodiment, for example, as shown in FIG. 12A, the average thickness of the portions of the sacrifice layer 15 remaining in the areas facing the sides of the vibration portion 11 in the frame wall 16 may be greater than the average thickness of the portions remaining in the other areas in the frame wall 16, and roughness of the sound hole shape reflecting structure may exist in the other areas, or alternatively, as shown in FIG. 12B, a configuration is possible in which the sacrifice layer 15 remains only in areas of the frame wall 116 that face the sides of the vibration portion 11, and the sacrifice layer 15 has been removed in the other areas of the frame wall 16. The four sides of the back plate 6 and the frame wall 16 facing the sides of the vibration portion 11 are relatively more likely to be damaged than the four corners, and therefore, if the sacrifice layer 15 at least remains so as to particularly follow the sides of the vibration portion 11, shock resistance is effectively improved, and furthermore, there is an advantage for downsizing of the acoustic sensor 1 because it is possible to reduce the surface area on which the sacrifice layer 15 is to remain.

Third Modified Example

FIG. 13 is a diagram of the third modified example in which an opaque thin film is further provided on the acoustic sensor 1, and in the case where the sacrifice layer 15 can be viewed through the back plate 6 and the frame wall 16 using various inspection apparatuses, there is a possibility that the acoustic sensor 1 in which the sacrifice layer 15 remains on the inner side of the frame wall 16 is handled as a defective product in which etching is insufficient. The sacrifice layer 15 is caused to remain on the inner side of the frame wall 16 by performing time control of etching, and therefore, for example, as seen from the comparison of FIG. 13A and FIG. 13B, there is a possibility that variation in the position of the sacrifice layer 15 occurs. If the position of the sacrifice layer 15 varies, there is a possibility that the sensor is handled as a defective product. In view of this, for example, if an opaque thin film 21 is deposited at least above a portion on which the sacrifice layer 15 remains, the sacrifice layer 15 cannot be viewed through the back plate 6 and the frame wall 16, and thus the possibility that the sensor is handled as a defective product can be reduced. Furthermore, a portion in which stress is likely to be applied structurally can be reinforced.

The invention claimed is:

1. An acoustic sensor that detects acoustic vibration by converting the acoustic vibration into change in electrostatic capacitance between a vibration electrode film and a fixed electrode film, comprising:

a semiconductor substrate having an opening in a surface thereof;

a back plate composed of a fixing plate and the fixed electrode film provided on the fixing plate, the fixing plate being arranged to face the opening of the semiconductor substrate and having a plurality of sound holes and the fixed electrode film provided on the fixing plate; and the vibration electrode film arranged between the back plate and the semiconductor substrate so as to face the back plate across a gap, wherein the fixing plate is provided by a semiconductor manufacturing process, and a frame wall is constituted with a curved shape in at least a portion of a periphery of the fixing plate, the frame wall being coupled directly or indirectly to the semiconductor substrate, and a sacrifice layer removed from an inner side of the fixing plate in the semiconductor manufacturing process remains at least on a portion of an inner side of the frame wall, with roughness of an inward surface of the remaining sacrifice layer being smaller than roughness of a sound hole shape reflecting structure in which a shape similar to an external shape of the sound holes is repeated, the roughness of the sound hole shape reflecting structure being formed in a case of removing the sacrifice layer using an etching liquid supplied from the plurality of sound holes in the semiconductor manufacturing process.

2. The acoustic sensor according to claim 1, wherein the plurality of sound holes are arranged inward of the opening of the semiconductor substrate as viewed from the normal direction of the fixing plate.

3. The acoustic sensor according to claim 1, wherein the semiconductor manufacturing process includes:

a step of depositing, on the surface of the semiconductor substrate before the opening is formed, a first sacrifice layer and a second sacrifice layer covering the first sacrifice layer;

a step of forming the vibration electrode film on the second sacrifice layer;

a step of depositing a third sacrifice layer so as to cover the vibration electrode film;

a step of removing the first sacrifice layer; and a step of removing a portion of each of the second and third sacrifice layers, wherein the sound holes are arranged inward of an external shape of the first sacrifice layer as viewed from the normal direction of the fixing plate.

4. The acoustic sensor according to claim 1, wherein the sacrifice layer is composed of at least two layers vertically, and a material of the sacrifice layer is selected such that an etching rate of a lower sacrifice layer is higher than an etching rate of an upper sacrifice layer in the semiconductor manufacturing process.

5. The acoustic sensor according to claim 1, wherein an opaque thin film is further deposited above at least a portion of the fixing plate on which the sacrifice layer remains, as viewed from the normal direction of the fixing plate.

6. The acoustic sensor according to claim 1, wherein the vibration electrode film has a vibration portion that is substantially quadrilateral as viewed from the normal direction of the fixing plate, and an average thickness of portions of the sacrifice layer remaining on areas of the frame wall facing sides of the vibration portion is greater than an average thickness of portions of the sacrifice layer remaining on other areas of the frame wall.

* * * * *